US005426930A

United States Patent [19]

Badiali et al.

[11] Patent Number: 5,426,930

[45] Date of Patent: Jun. 27, 1995

[54] DEVICE FOR SEQUENTIALLY LOADING ORIENTED TUBES IN A SPINNING MACHINE

[75] Inventors: Roberto Badiali, Pordenone; Amedeo Quaia, Porcia; Luciano Bertoli, Pordenone, all of Italy

[73] Assignee: Savio, S.p.A., Pordenone, Italy

[21] Appl. No.: 217,087

[22] Filed: Mar. 25, 1994

Related U.S. Application Data

[63] Continuation of Ser. No. 719,778, Jun. 24, 1991, abandoned.

[30] Foreign Application Priority Data

Jun. 29, 1990 [IT] Italy ..... 20810/90

[51] Int. Cl.[6] ..... D01H 9/10; D01H 9/14

[52] U.S. Cl. ..... 57/281; 57/90; 198/532; 242/35.5 A

[58] Field of Search ..... 242/35.5 A; 57/281, 57/90; 198/463.6, 487.1, 400, 532

[56] References Cited

U.S. PATENT DOCUMENTS

| | | | |
|---|---|---|---|
| 2,558,633 | 6/1951 | Tuttle | 198/463.6 |
| 2,824,484 | 2/1958 | Thompson | 198/463.6 X |
| 3,082,908 | 3/1963 | Ingnam | 57/281 X |
| 3,328,948 | 7/1967 | DuBuis et al. | 198/400 X |
| 3,776,346 | 12/1973 | DuBuit | 198/400 X |
| 3,863,751 | 2/1975 | Vignon | 57/281 X |
| 3,938,308 | 2/1976 | Komura et al. | 57/281 X |
| 4,181,228 | 1/1980 | Hashimoto et al. | 57/281 X |
| 4,550,865 | 2/1986 | Kawarabashi et al. | 242/35.5 A |
| 4,566,263 | 1/1986 | Miyazaki et al. | 57/281 X |
| 4,586,668 | 5/1986 | Mori | 242/35.5 A |
| 4,624,360 | 11/1986 | Walk et al. | 242/35.5 A X |
| 4,660,367 | 4/1987 | Kawarabashi | 57/276 X |
| 4,660,387 | 4/1987 | Kawarabashi | 57/281 X |
| 4,703,618 | 11/1987 | Dinkelmann | 57/281 X |
| 4,730,450 | 3/1988 | Tone | 57/281 |
| 4,777,907 | 10/1988 | Sanger | 198/400 |
| 4,907,688 | 3/1990 | Kupper | 198/532 X |

FOREIGN PATENT DOCUMENTS

| | | | |
|---|---|---|---|
| 0290063 | 11/1988 | European Pat. Off. . | |
| 1498137 | 9/1967 | France | 57/206 |
| 2084639 | 12/1971 | France . | |
| 2538273 | 3/1977 | Germany . | |
| 3336958 | 4/1984 | Germany | 242/35.5 A |
| 3414432 | 10/1985 | Germany . | |
| 3532915 | 4/1987 | Germany . | |
| 22755 | 12/1989 | Italy . | |

*Primary Examiner*—Daniel P. Stodola
*Assistant Examiner*—William Stryjewski
*Attorney, Agent, or Firm*—Robert D. Schaffer; Rogers & Wells

[57] ABSTRACT

A device for sequentially loading tubes in a spinning machine wherein the tubes are fed by a tube orientating device. The device disclosed includes a duct for guiding the fall of the tubes and provided at its lower end with a shutter which loads one tube at a time onto the pegs of the spinning machine doffing belt by withdrawing it from a stack of tubes accumulated within the duct to form a buffer stock.

9 Claims, 3 Drawing Sheets

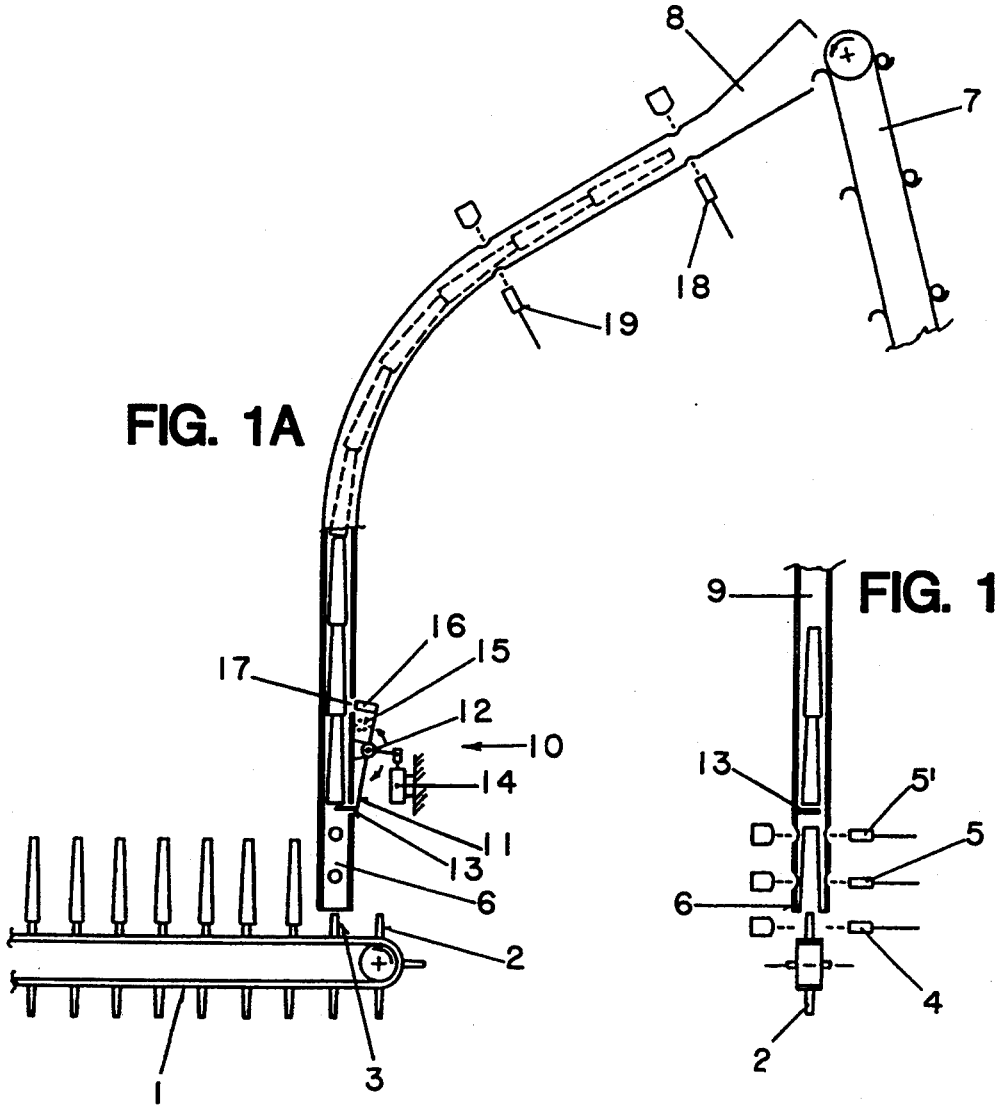
FIG. 1A
FIG. 1C
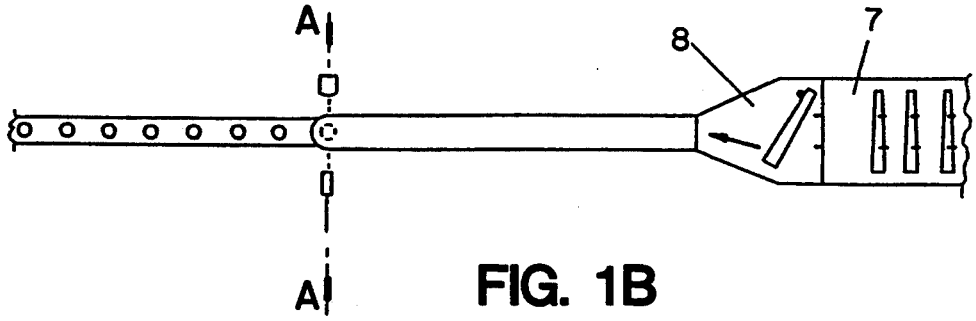
FIG. 1B

DEVICE FOR SEQUENTIALLY LOADING ORIENTED TUBES IN A SPINNING MACHINE

This is a continuation of application Ser. No. 07/719,778, filed Jun. 24, 1991, now abandoned.

BACKGROUND OF THE INVENTION

This invention relates to spinning devices and in particular to ring spinning devices, in which the produced yarn is wound in the form of packages onto generally conical tubes which form the package core.

The yarn packages are completed at a predetermined wound length and are then fed to the next process, generally winding, in which the produced yarn is rewound to remove defects and improve product quantity, and to produce larger-sized bobbins, the empty tubes being returned to the spinning stage for their reuse.

The empty tubes and produced packages are conveyed within the spinning machine by conveyors currently known as dolling belts, on which erect positioning pegs are provided for the tubes and packages, these pegs being either fixed to the belt surface in a perpendicular position or on base discs disposed on the belt.

The spinning machine dolling members deposit the finished packages to be removed from the spinning machine onto the dolling belt and withdraw empty tubes from other positions on the belt to reposition them in the spinning stations to again wind new yarn onto them to form new packages.

European patent application No. 88200602 of the present applicant describes gripping members for doffing the packages and tubes. At one end of the belt there is an empty tube loading station in which the belt presents the pegs for filling with said tubes to be returned to the spinning stations for the next doffing operation. These tubes may be either new tubes taken from the tube store, or tubes which were emptied during the winding stage following the spinning stage, and recycled.

As spinning machines of recent design comprise a large number of spinning stations, perhaps one thousand or more, and considering that the packages are doffed either all together or in groups at the same moment, the doffing operation may require the unloading of one thousand or more packages simultaneously and the repositioning of one thousand or more empty tubes, which then have to be reinstated within the required time on the dolling belt.

The present invention provides a device for reinstating the empty tubes on the doffing belt so as to make them available to the spinning stations for the next dolling operation.

BRIEF DESCRIPTION OF THE DRAWINGS

FIGS. 1A, 1B, and 1C are plan views of a device according to the present invention.

Figure 2A:
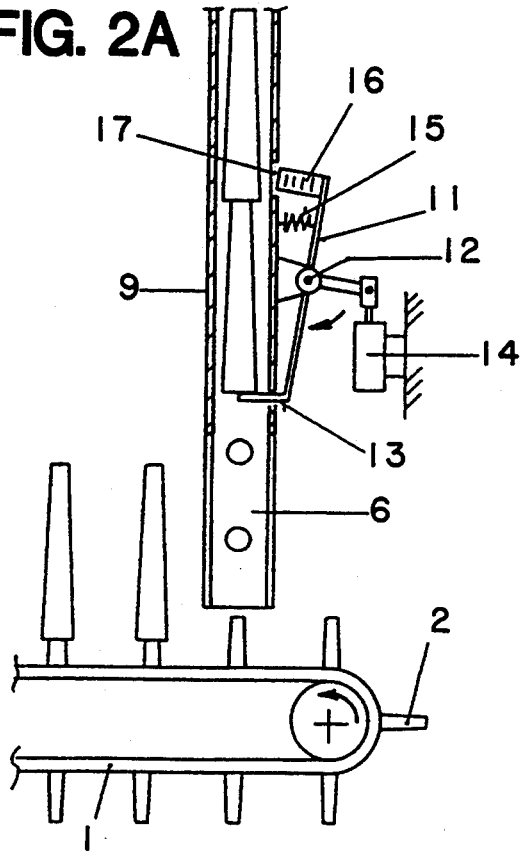
FIGS. 2A and 2B are detail sections of FIGS. 1A, 1B, and 1C.
Figure 2B:
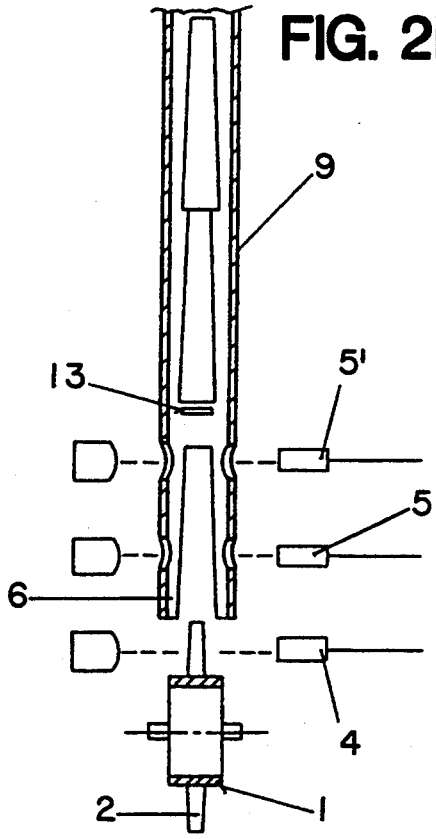
Figure 3A:
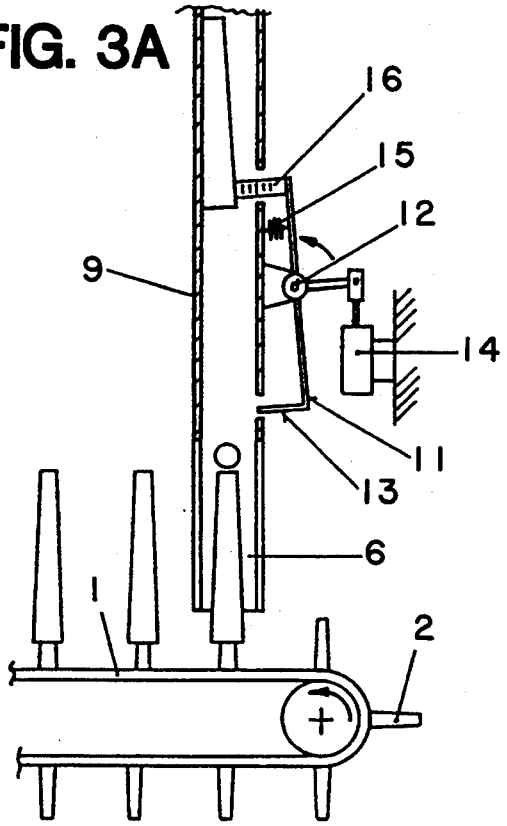
FIGS. 3A and 3B are details of the operation of the invention.
Figure 3B:
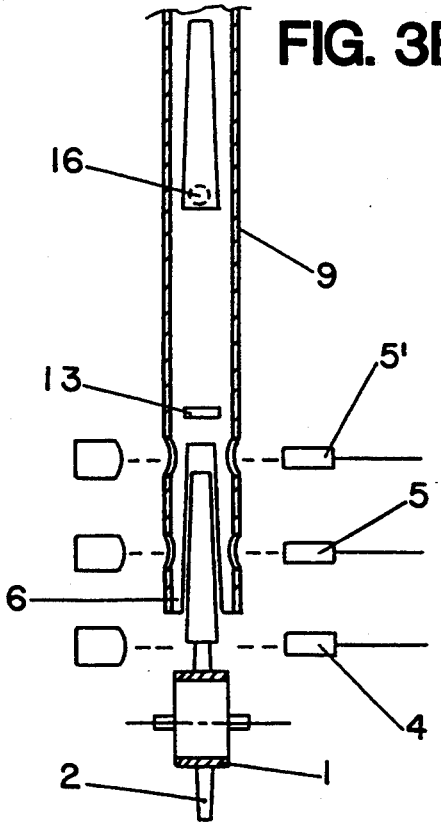

The device and method for feeding empty tubes onto the vertical pegs of the dolling belt according to the invention is described with reference to a typical embodiment shown in FIGS. 1A, 1B, and 1C by way of non-limiting example.

The conveyor belt 1 provided with pegs 2 for positioning the tubes to be fed moves stepwise towards the left to present in the tube loading position 3 those pegs on which the tube under reinstatement is to be positioned. If one tube is to be positioned every two pegs the advancement pitch of the belt 1 must correspond to the distance between two pegs. If however a tube is to be positioned on all the pegs the pitch corresponds to the distance between two pegs.

In position 3 there are three sensors, such as photoelectric cells 4, 5 and 5', the first of which—in the lower position—senses whether the peg has been presented in the correct position to receive the tube.

The tube loading operation is dependent on its enabling by the sensor 4.

After the loading operation the sensors 5 and 5' jointly determine when the tube has been loaded and is correctly positioned on the peg, to enable the doffing belt to undergo the next step and present the next peg for the next loading of a further tube.

If there is no tube present on the peg, the sensors 5 and 5' both receive the returning signal, however if the tube is present and correctly engaged on the peg the lower sensor 5 does not receive the returning signal (intercepted by the tube) whereas the upper sensor 5' receives it (the tube does not intercept it), but if the tube has not been properly lowered onto its peg and remains raised neither of the sensors receives returning signals (the tube intercepts them both).

In position 3 there is a lead-in for guiding the tube into position, such as a funnel-shaped member open in the direction of movement of the belt to accompany the tube during its fall onto the peg. Alternatively this lead-in can be in the form of a partial lateral prolongation 6 of the tubular structure towards the peg 3 to accompany the tube.

The upper part of the device comprises members 7 for raising the empty tubes from the tube store and/or from the recycle tube conveyor, and members 8 for orientating them, in the case of conical tubes, with their larger-diameter end to the front. These devices are for example described in Italian patent application No. 22788 A/89 of the present applicant.

Said tubes are fed one at a time by the members 7 and 8 to the collection hopper which forms the initial part of the vertically or at least steeply positioned tubular duct 9, which guides the tubes during their gravity descent to the loading position 3.

The duct 9 is shaped in such a manner as to contain the tubes and guide them in sequence during their descent, without them jamming, the duct preferably extending through a large radius of curvature and having a diameter which is slightly greater than, and indicatively between 1.2 and 1.8 times, that of the major diameter of the tube.

At the lower end of the duct 9 there is a tube 10 dispensing member for loading an individual tube onto each peg presented by the conveyor 1.

In the embodiment shown in FIGS. 2A, 2B, 3A, and 3B this consists of a lever 11 having a fulcrum 12 and able to assume positions in which the duct 9 is open, or is closed by the shutter 13, which either leaves the exit of the duct 9 free or intercepts it.

The lever 11 can be operated by means known in the art, for example comprising a rotating cam-shaped profile or a pneumatic cylinder 14, which operate in the sense of opening the shutter 13 against a return spring 15 which tends to keep it closed.

On the rocker lever 11 at the end distant from the shutter 13 there is provided a member 16 which obstructs the fall of the penultimate tube by penetrating through a slot 17 in the duct 9 to engage said tube and lock it against the duct wall, so halting the overlying column of tubes. The end part of the member 16 can be formed from a soft material with good adherence characteristics such as rubber or plastics, to prevent damaging the tubes and to reliably retain them.

Each time the shutter 13 is opened a single tube is deposited, the column of tubes being allowed to advance through one step downwards only when the shutter 13 has been reclosed.

Sensors 18 and 19, such as photoelectric cells, are positioned in the top of the duct 9 to control the filling of the duct 9 with tubes to be fed to the belt 1. The upper sensor 18 controls the maximum allowable tube stacking level and the lower sensor 19 controls the minimum level. This arrangement results in considerable advantages in the tube reinstatement operation. When the level of the stack falls below the minimum level the system comprising the raising member 7 and orientating member 8 is operated to reinsert tubes into the duct 9 until the maximum level is reached. When this level is exceeded these members are halted. In the known art, ducts similar to the duct 9 are used to guide individual tubes supplied by a raising/orientating system so that they fall onto a peg, in such a case the duct 9 being occupied by one tube at a time. Such a device and operating method have considerable drawbacks, which are overcome by the present invention. In this respect, in falling from a considerable height the tubes unnecessarily stress the belt 1 and its pegs; again, if the raising member 7 has empty positions, as can happen when picking up random or disordered tubes, such empty positions inevitably lead to idle periods in reinstating the tubes at the belt 1.

In contrast, if the duct 9 is kept continuously filled with a determined quantity of tubes the height through which a tube falls onto a peg is little more than the height of the tube itself, with the result that the tube produces little impact, and occasional empty positions on the raising member 7 have no repercussions on the time for reinstating the tubes on the belt, as the stacked tubes act as a buffer. In this respect, the raising/orientating system is preferably constructed to produce a tube delivery rate which is slightly faster than the stepping rate of the doffing belt so as to overcome occasional empty positions on the raising member 7 without introducing delays in reinstating the tubes at the belt.

With the device according to the invention the tube loading rate is substantially faster as the feed rate of the raising device 7 and the loading rate of the dispenser 10 are substantially independent. The time for a tube to pass through the duct 9 does not influence the loading rate, as is the case when only one tube passes through the duct 9 at a time. The time saved in delivering a tube is about two seconds, this saving being very significant for spinning machines comprising a large number of spinning stations.

The duct 9 can be constructed simply and economically of a natural or synthetic polymer material such as transparent plastics, thus allowing visual monitoring of its proper operation and providing good adherence for locking the tube column. This construction also makes it easier to mount the device and to centre it about the tube receiving position 3.

Figure 4A:
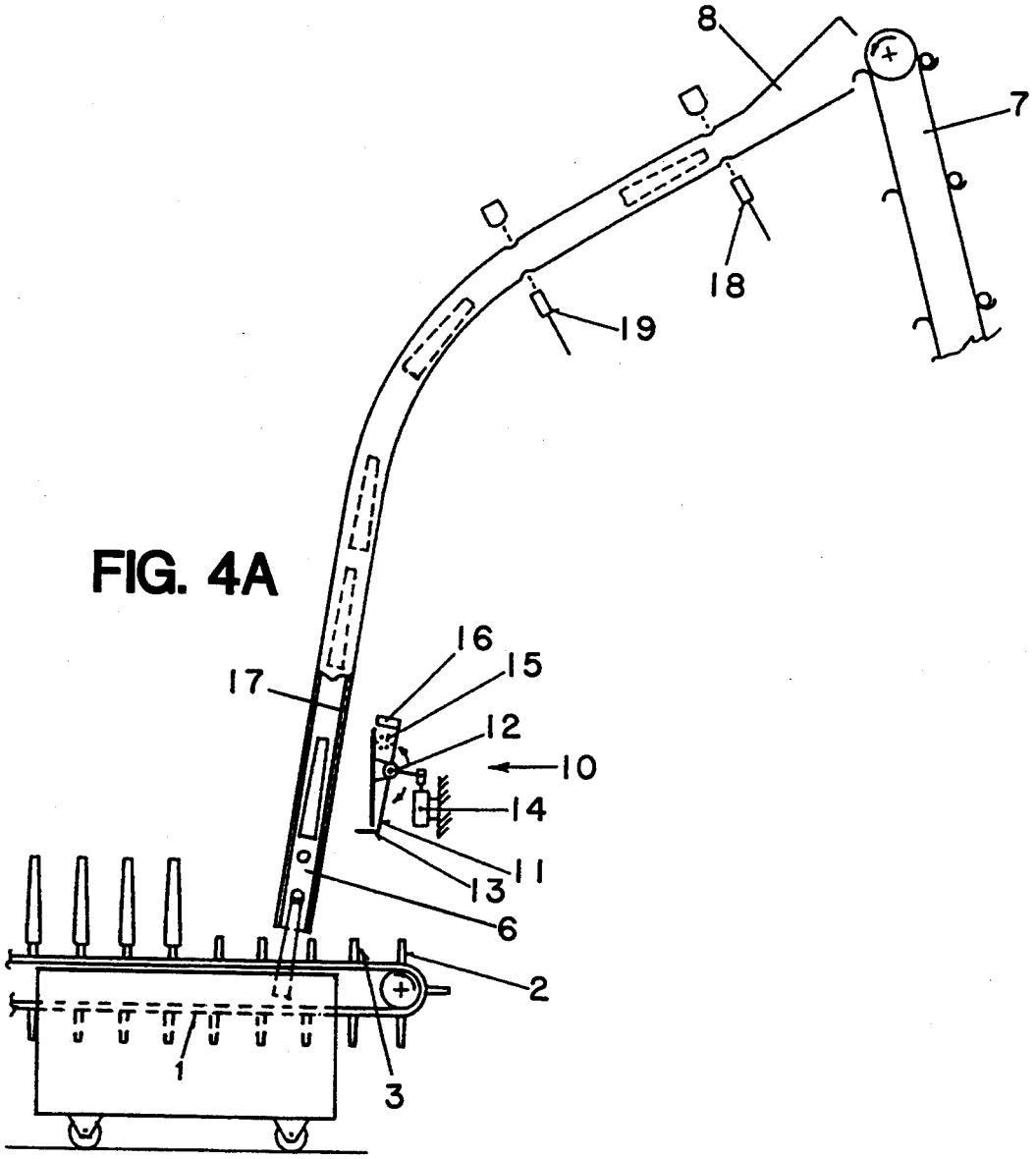
FIGS. 4A and 4B show the displacable vertical duct of the instant invention.
Figure 4B:
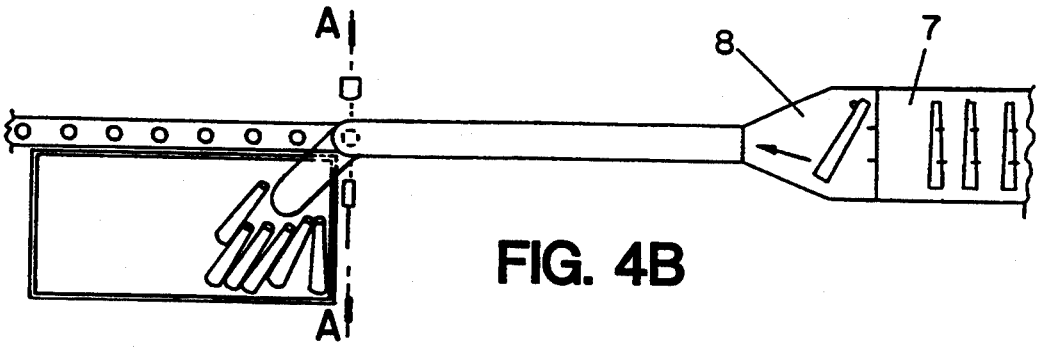

If a flexible material with good elastic return characteristics is used for the duct 9 the stack of tubes can be locked without providing the slot 17, by simply pressing the member 16 against the wall of the duct 9, so squashing it sufficiently to prevent the downward sliding of the stack lying above the pressing point. This is shown in FIGS. 4A and 4B. Constructing the duct 9 of an elastically deformable material also allows the lower end of the duct to be moved from the normal position used for loading the tubes onto the pegs, to adjacent positions. By constructing the duct of elastically deformable material, the duct is able to be transversely displaceable both horizontally and vertically while being maintained in a substantially vertical position.

This unusual operation is useful for example when the process is to be changed, and different tubes used. By this means the existing tubes can be removed from the spinning machine by discharging them into a collection bin.

In this case the control sensors are switched off by a manually operated selector switch and the dispenser 10 is not moved. The lower end of the duct 9 is moved over the bin and the raising member 7 operated, this then moving continuously as it is no longer controlled by the sensors 18 and 19, the result being that all the tubes located upstream of 7 are discharged and can be replaced by the new tubes. When changing the tubes, it is has been found to be most convenient to first stop the delivery of the tubes by the raiser 7 to the duct 9 and discharge the existing tubes within the duct 9 by operating the dispenser 10, then deviating the duct 9 into the collection bin and operating the raising member 7 without the control of sensors 18 and 19. In such way all the tubes are discharged from the machine into the bin.

We claim:

1. A device for sequentially loading tubes of a spinning machine onto a belt having vertical pegs, wherein the tubes have a longitudinal axis, comprising:

a) a vertical duct having a feed port and an exit port, wherein said vertical duct is transversely displaceable horizontally and vertically while being maintained in a substantially vertical position, and wherein said exit port is vertically positioned above the pegs of the belt;

b) feeding means for feeding and orienting the tubes in said feed port of said vertical duct and for vertically stacking the tubes coaxially therein along the longitudinal axis of the tubes;

c) dispensing means operatively associated with said vertical duct for sequentially dispensing the tubes from said exit port of said vertical duct onto the pegs of the belt, whereby the tubes are vertically positioned onto the pegs;

d) first sensing means positioned proximate said exit port of said vertical duct and adapted for sensing when a peg is positioned vertically below said exit port of said vertical duct and for activating said dispensing means; and e) second sensing means positioned proximate said exit port of said vertical duct and adapted for sensing when a tube has been properly loaded onto a peg and for then activating the belt for positioning another peg vertically below said exit port of said vertical duct.

2. The device of claim 1, wherein said vertical duct is flexible.

3. The device of claim 1, wherein said dispensing means comprises a lever having a first arm, a second arm, and a pivot therebetween, wherein said lever is adapted for pivoting from a first position to a second position about said pivot, wherein when said lever is in said first position, said first arm is adapted for intercepting the tubes in said vertical duct and said second arm is adapted for dispensing a tube from said vertical duct onto the pegs of the belt, and when said lever is in said second position said second arm prevents the tubes from dispensing from said vertical duct.

4. The device of claim 3, wherein said vertical duct comprises elastically deformable material and said first arm is adapted for elastically deforming said vertical duct for intercepting the tubes in said vertical duct when said lever is in said first position.

5. The device of claim 3, wherein said first arm of said lever penetrates a slot in said vertical duct for intercepting the tubes in said vertical duct when said lever is in said first position.

6. The device of claim 3, further comprising biasing means operatively associated with said lever for biasing said lever in said second position.

7. The device of claim 1, further comprising a level sensor operatively associated with said vertical duct for controlling the amount of tubes fed in said vertical duct.

8. The device of claim 1, further comprising a minimum level sensing means operatively associated with said vertical duct and adapted for controlling the amount of tubes in said vertical duct and for activating said feeding means for feeding tubes to said vertical duct, and a maximum level sensing means operatively associated with said vertical duct and adapted for deactivating said feeding means for controlling the amount of tubes in said vertical duct.

9. The device of claim 8, wherein the tubes are fed in said vertical duct so as to be at a level between said minimum level sensor and said maximum level sensor.

* * * * *